United States Patent [19]

Kondo et al.

[11] 4,106,870

[45] Aug. 15, 1978

[54] COLOR ELECTROPHOTOGRAPHIC METHOD AND APPARATUS

[75] Inventors: Eiichi Kondo, Kawasaki; Hajime Katayama; Toru Takahashi; Yutaka Komiya, all of Tokyo, Japan

[73] Assignee: Canon Kabushiki Kaisha, Tokyo, Japan

[21] Appl. No.: 535,083

[22] Filed: Dec. 20, 1974

[30] Foreign Application Priority Data

Dec. 28, 1973 [JP] Japan ..... 49-918

[51] Int. Cl.[2] ..... G03G 15/01

[52] U.S. Cl. ..... 355/4; 355/14; 96/1 C

[58] Field of Search ..... 355/3 R, 3 CH, 4, 8, 355/11, 14; 96/1 C, 1.2; 346/74 ES, 74 EK; 101/DIG. 13; 118/645

[56] References Cited

U.S. PATENT DOCUMENTS

| | | | |
|---|---|---|---|
| 3,195,405 | 7/1965 | Clark et al. | 355/71 X |
| 3,702,483 | 11/1972 | Fantuzzo | 96/1.2 UX |
| 3,705,767 | 12/1972 | Tamai et al. | 355/4 |
| 3,724,941 | 4/1973 | Honjo et al. | 355/11 X |
| 3,729,311 | 4/1973 | Langdon | 355/4 X |
| 3,749,488 | 7/1973 | DeLorme | 355/3 R |
| 3,762,811 | 10/1973 | Matsumoto | 355/3 R |
| 3,799,668 | 3/1974 | McVeigh | 355/4 |
| 3,815,988 | 6/1974 | McVeigh et al. | 355/4 X |
| 3,825,337 | 7/1974 | Lucas | 355/4 |
| 3,928,033 | 12/1975 | Anzai | 96/1.2 |

*Primary Examiner*—William M. Shoop

*Attorney, Agent, or Firm*—Fitzpatrick, Cella, Harper & Scinto

[57] ABSTRACT

Color electrophotographic method and apparatus capable of providing color representation faithful to an original by the provision of well designed color balance control devices. The method of the invention comprises a step of exposing a color resolving image of an original onto a photosensitive medium to develop an electrostatic latent image formed according to the resolving image or an electrostatic image according to the first-mentioned image with fixed color developer, the step being repeated in number according to the color resolution to represent color one above the other on an image carrier such as a photosensitive medium.

24 Claims, 27 Drawing Figures

COLOR ELECTROPHOTOGRAPHIC METHOD AND APPARATUS

BACKGROUND OF THE INVENTION

1. Field of the Invention

The present invention relates to color electrophotographic methods for representing color resolving images of an original to obtain a color image, and more particularly to a color electrophotographic method and apparatus wherein a color balance of each color resolving image may be well controlled.

2. Description of the Prior Art

In order to represent color images, a conventional method is provided to obtain a color image by forming an electrostatic latent image according to a color resolving image of an original and developing it using a color developer, that is, a toner of the color cyan, magenta, yellow or black if so required.

To obtain a well color-balanced image, however, it is necessary to establish substantially the same relationship between the original image density (Do) of each image in cyan, magenta, and yellow and the print image density (Dp), as will be illustrated in FIG. 1. In the event the three curves (as shown in FIG. 2) of Do - Dp characteristics for these colors do not coincide, a copy having red lacking in yellow in the reproduced color may be obtained from a red original, a blue-green copy may be obtained from a green original, and a red-purple copy may be obtained from a purple original, and hence an image faithful to the original may not be obtained.

In the color reproduction according to the electrophotographic method, the relationship between each surface potential (V) of developer used to visualize electrostatic latent images, i.e., cyan, magenta and yellow toners, and the image density (D) are not identical. This is one of the reasons why the Do - Dp curves for the above-described colors do not coincide. In order to solve the problem noted above, efforts have heretofore been made to improve the developing characteristic of the toner with respect to the electrostatic latent image so as to approximate an ideal characteristic as shown in FIG. 1.

However, it is very difficult to completely control the developing characteristics of toner, and satisfactory results have not been obtained so far.

On the other hand, the relationship between the surface potential (V) of the electrostatic latent image on the photosensitive plate and the exposure (E) may vary according to each of the red, green, and blue filter exposures and it is difficult to make them identical. As a consequence, even if the V – D characteristics of the three toners should coincide, inconvenience may occur. That is, in the device for carrying out the color representation, due to the presence of different characteristics between color resolving filters, and of differences in wavelength sensitivity between photosensitive media, irregularity in characteristics for each device, and irregularity in characteristics of toner to be supplied, colors represented may vary. Thus, there is produced a possibility of extremely adverse effects on the color balance. In order to realize a preferable color representation, accordingly, it is necessary to experimentally control the electrostatic representation of each color resolved image and the color balance with one another according to each of the factors influencing color reproduction, but this requires skills and time. Furthermore, adjustment for variations with time would be required.

Thus, it has been extremely difficult to keep excellent color reproduction possible in a better fashion with stability for a long period of time.

The present invention is proposed in view of the foregoing and to accomplish the following objects.

SUMMARY OF THE INVENTION

An object of the present invention is to provide a color electrophotographic method and apparatus which is capable of providing color representation faithful to an original.

A further object of the invention is to provide a color electrophotographic method and apparatus which can well control a color balance among color resolving images of the original and can provide excellent color representation.

Another object of the invention is to provide a color balance color device which can readily establish a suitable color balance.

A still another object of the invention is to provide a color balance control device which can wholly establish a predetermined color balance.

Briefly stated, the present invention comprises a step of exposing a color resolving image of an original onto a photosensitive medium to form an electrostatic latent image according to said resolving image, and a step of developing that image with use of a predetermined color developer. These steps are repeated with respect to predetermined colors to represent a predetermined color, whereby the electrostatic latent image is controlled by a set value corresponding to each step of representing each of the color resolving images in accordance with a set value of a potential of the electrostatic latent image determined according to each of the color resolving images.

The term "image carrier" refers herein to a photosensitive medium, a latent image transfer medium or a member capable of holding an electrostatic image, and a member for holding a developed image and so on.

Other objects and structures of the present invention will be understood by those skilled in the art from the following description of the embodiments with reference to the accompanying drawings.

DESCRIPTION OF THE PREFERRED EMBODIMENTS

Figure 1:
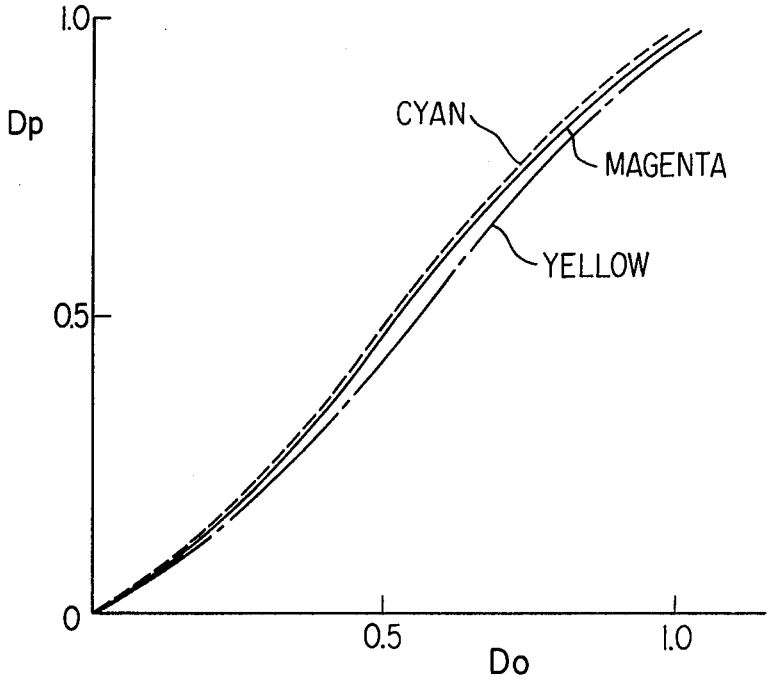
FIG. 1 is a development characteristic curve of an ideal polychromatic developer.
Figure 2:
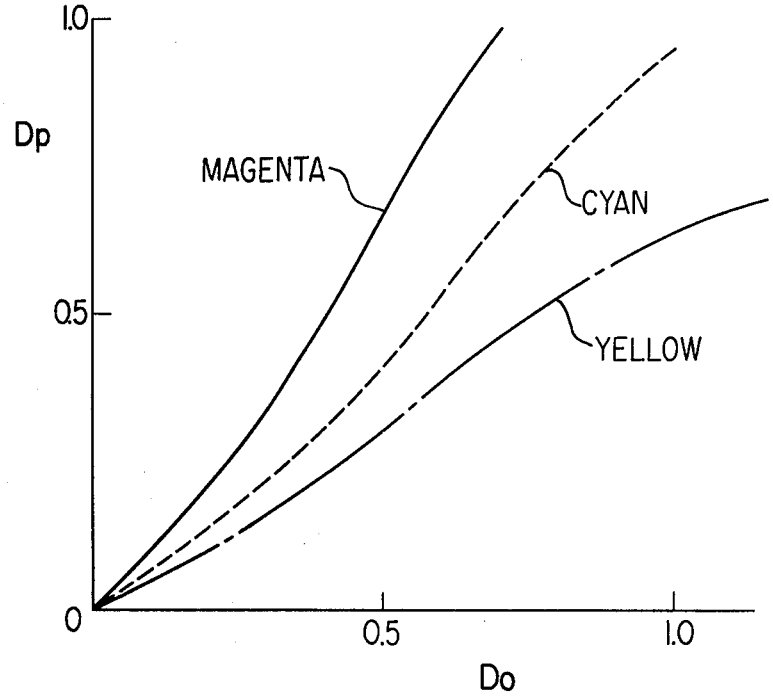
FIG. 2 is a characteristic curve showing a conventional developer.
Figure 3:
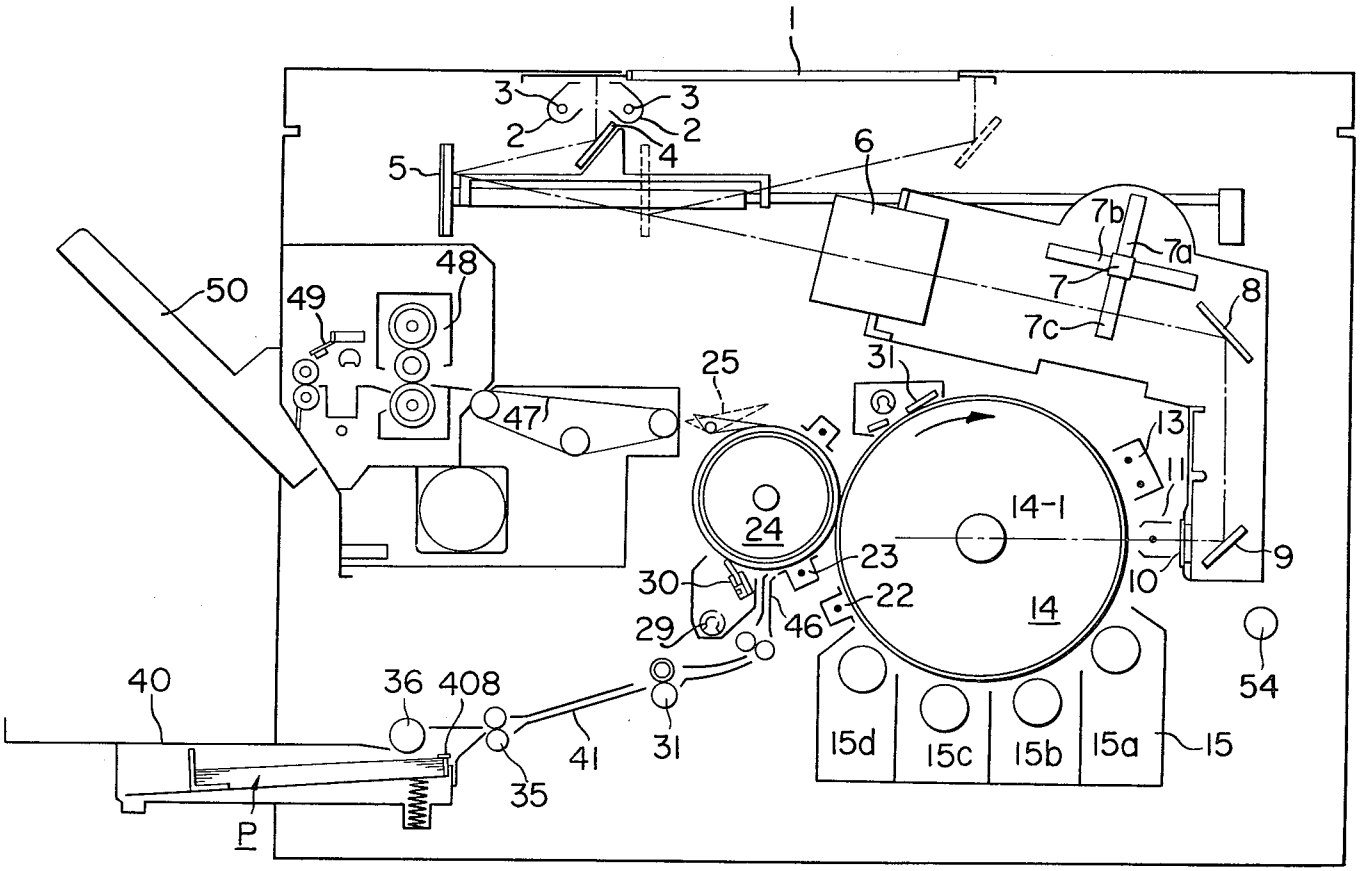
FIG. 3 is a side view of assistance in explaining the color copying machine in a preferred form to which the present invention is applied.

Referring now to FIG. 3, there is shown a preferred embodiment of a color copying machine to which the method of the present invention is applied. An original on a transparent glass plate 1 of an original carriage is illuminated by an illuminating light source (an iodine lamp 3 and a reflecting shade 2) provided with a first scanning mirror, the reflected light beam being scanned by the first scanning mirror 4 and second scanning mirror 5. The first and second scanning mirrors are moved at a speed ratio of 1 : ½ to scan the original while always maintaining the first half optical length of a lens system 6 constant.

The above-described light image reaches a color resolving filter 7 through the lens 6. Said filter 7 has portions *7a, 7b,* and *7c* corresponding to three colors (R, G, and B) to color-resolve the light image, which light image thus resolved is focused on a photosensitive drum 14 through fixed third mirror 8 and fourth mirror 9 and further a dust-proof closed glass 10. The photosensitive drum 14, which is rotatably supported on a shaft $14_1$, rotates in the direction as indicated by the arrow as printing operation proceeds, and is charged (for example, positive +) by means of a primary charger 13. The drum is then discharged by means of an AC discharger 11 while the color-resolved light image is projected onto the surface of the drum by use of an overall exposure lamp 54 to obtain an electrostatic latent image of high contrast.

The electrostatic latent image on the photosensitive drum 14 is then visualized by means of a developing device 15. This developing device 15 comprises four developing devices 15*a,* 15*b,* 15*c,* and 15*d* for use of C-M-Y and B and W, and a powder image is formed by a developing device 15*c* corresponding to a color resolving filter (for example, by a yellow developing device for a blue filter).

After completion of development, the powder image on the photosensitive drum is charged with suitable polarity by means of a post charger 22.

Sheets of transfer paper P are stored in a cassette 40 detachably mounted on the machine, and a pick-up roll 36 is rotated and lowered as the photosensitive drum rotates until it comes into contact with the uppermost sheet of transfer paper within the cassette. The pick-up roll is further lowered so that a separating pawl $40_8$ may operate by its own weight to feed the paper P out of the cassette. At the same time when the pick-up roll 36 is operated, a first timing roll 35 stops on which the transfer paper P fed out of the cassette impinges to form a loop, and the transfer paper stops for a moment and thereafter reaches a second timing roll 31 through a guide 41. The second timing roll 31 stops little before the transfer paper has reached, and accordingly the transfer paper P impinges on the second timing roll 31 to form a loop and stops. Thereafter, the second timing roll 31 may be operated in synchronism with the powder image on the photosensitive drum. The transfer paper P comes into contact with a transfer roll 24 through a guide 46 and will have its back subjected to a corona discharge of the same polarity as that of the post charge by means of an electrostatic absorption charger 23 and as a result the transfer paper P may be electrostatically placed on the transfer roll 24. This transfer roll 24 comprises a metal roll $24_2$, on the outer periphery of which an elastic roll $24_1$ is disposed, on which a conductive rubber $24_3$ is wound to form an outermost layer, and is grounded. The transfer paper P electrostatically absorbed on the transfer roll 24 is pressed in synchronism with the powder image on the photosensitive drum to transfer the powder image so that a yellow powder image may be formed on the transfer paper.

In a process similar to the above, sequential steps of exposure, development (cyan, magenta), and transfer may be repeated with use of other red and green filters. The transfer paper P on the transfer roll may be transferred three times in all while being electrostatically absorbed. In the case of the apparatus according to the invention, the ratio of diameter of the photosensitive drum to diameter of the transfer drum is 2 : 1 and they are directly connected by a gear, and therefore the synchronism therebetween is never disordered. Also, the color resolving filter 7 is changed into next filter during the time of inverse process of the optical system. Each of the filters is associated in operation with corresponding ones of the developing devices on a one-for-one basis under the control of a programming device. Thus, selection of a color filter leads to selecting a corresponding color developing device.

Upon completion of color resolving exposure through R - G - B filters, development of C - M - Y toner, three consecutive times of transfer, the separating pawl 25 may be operated by the programming device to disengage the transfer paper P electrostatically absorbed from the transfer roll 24, and through a conveyor belt 47 the powder image on the transfer paper P is heated, molten and fixed at a fixing device 48. Further, static electricity on the transfer paper is discharged by means of a discharger 49 to discharge the transfer paper onto a tray 50. After the transfer paper P has been disengaged, the instructions of the programming device cause the transfer roll cleaner 30 to operate thereby cleaning the transfer roll, and the toner removed by the blade cleaner is delivered toward one side by means of a screw 29 disposed below so as to be collected within a toner receiver. Further, after completion of transferring the powder images of each color, the photosensitive drum 14 will have its surface cleaned by a cleaning device comprised of a resilient blade 31 to be ready for next cycle.

Figure 4:
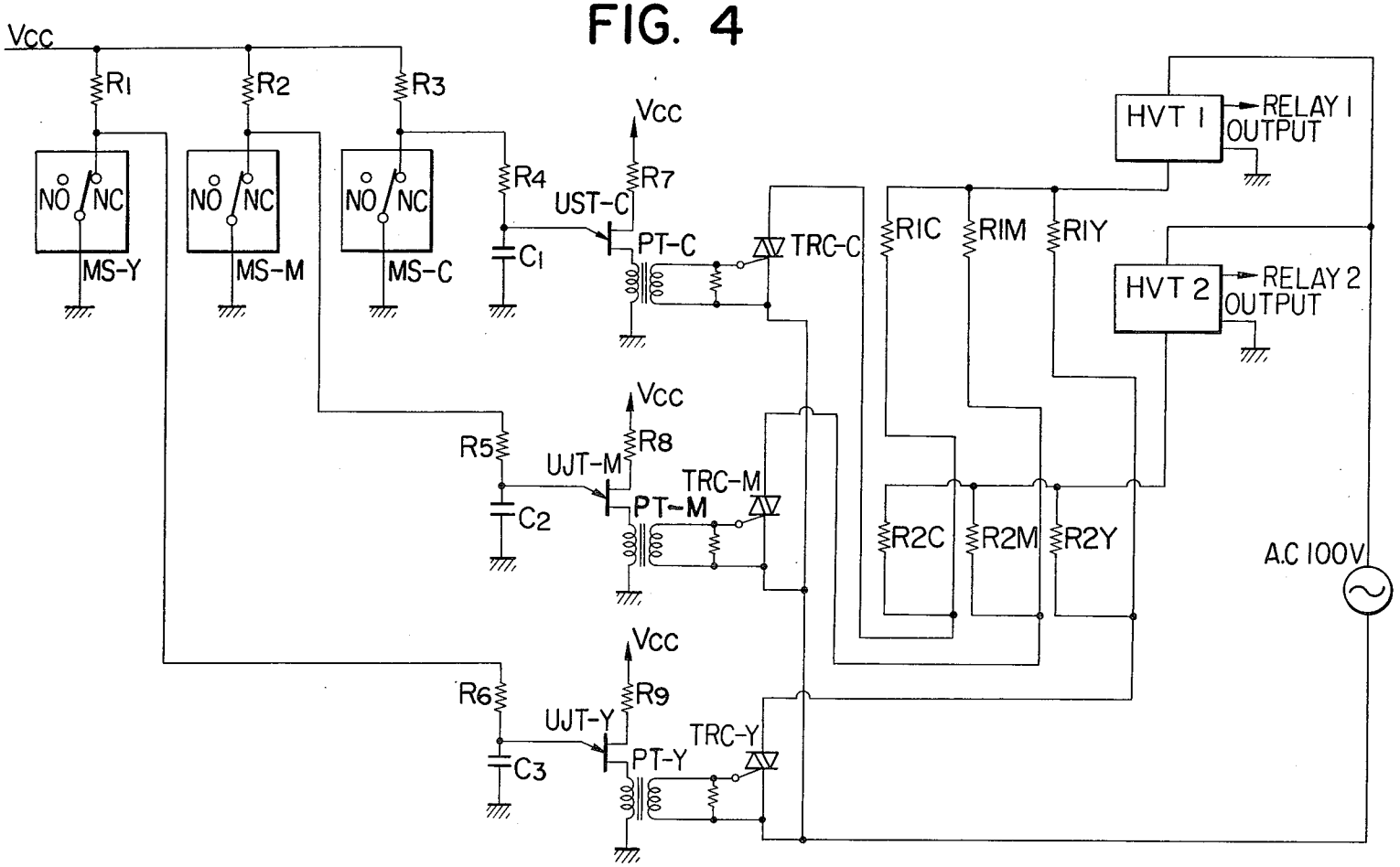
FIG. 4 is a circuit diagram of a preferred embodiment wherein potential control of the electrostatic latent image is effected.

FIG. 4 illustrates a charge control circuit in the embodiment of the above-mentioned apparatus. When the filter 7 is changed-over, micro-switches MS-Y, MS-M, and MS-C are changed-over so that voltages generated by high voltage sources HVT-1 and HVT-2 of each charger may be set by $R_1Y$, $R_2Y$, or the like. That is, for example, in the process of yellow development, the microswitch MS-Y is set to NO side to pass a current from the power source through $R_1$ and $R_6$ so that a unijunction transistor UJT-Y begins to oscillate. TRC-Y is energized through a pulse transformer PT-Y to pass a predetermined current to each primary through $R_1Y$ for the primary charging DC source HVT-1 or $R_2Y$ for the secondary opposite polarity charging DC source or discharging AC source HVT-2 thereby generating a high voltage required for the yellow representing process. In this manner, an optimum condition for forming a visual image may be obtained.

Figure 5:
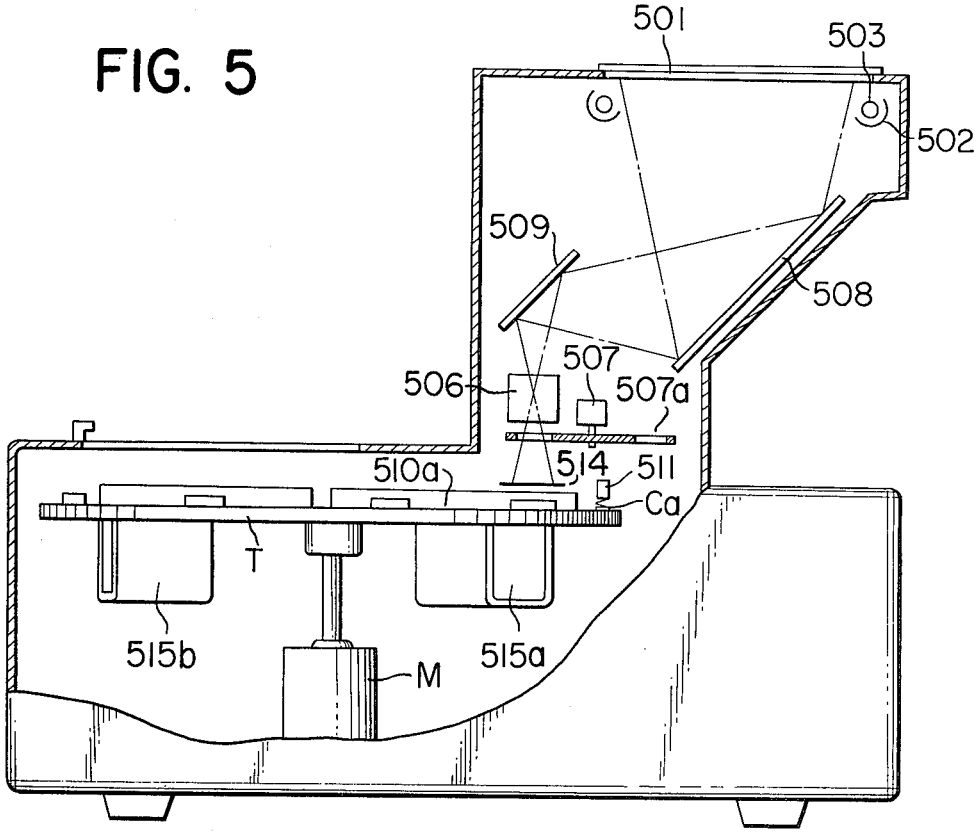
FIG. 5 is a side view of assistance in explaining the Fax Type color copying machine in a preferred form to which the present invention is applied.

The present invention is not limited to the electrophotographic process shown in the above-mentioned embodiment but it may be equally applied to the Carlson process, and in addition it will be also apparent that the method of the invention may be effectively applied to those cases wherein development is effected after transfer of latent image without performing development on the photosensitive drum or after forming an electrostatic image according to the electrostatic latent image formed on the photosensitive drum. In the case of the latter, particularly, the method of the invention may be effectively utilized because it may control a potential of a latent image on the photosensitive drum and it may also readily control a potential of an electrostatic image on the transfer paper. It will be of course apparent that the method of the invention may be effectively utilized for color representation of not only transfer type but also Fax type electrophotography as shown in the apparatus of FIG. 5. In the FIG. 5 apparatus, the image of the original is focused on a photosensitive medium 514' by a lens 506 through two fixed mirrors 508 and 509. A color resolving means designated at 507 is provided with filters such as 507*a*, etc. On the other hand, disposed on a disc T are a charge 510*a*, a developing device 515*a*, etc. arranged so as to perform steps of charging, exposing, developing and drying for each color to form color images.

Figure 6:
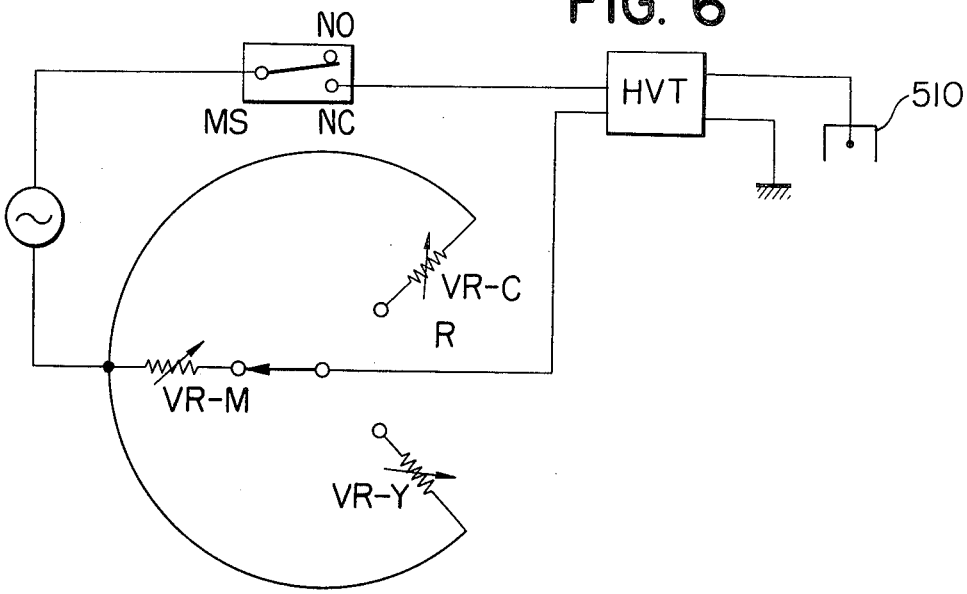
FIG. 6 is a circuit diagram of a preferred embodiment wherein control of the apparatus shown in FIG. 5 is effected.

A control mechanism under the charging condition applied to the above-described apparatus is shown in FIG. 6. In this Figure, variable resistors VR-C, VR-M and VR-Y are provided to control charging voltages of cyan, magenta, and yellow, respectively. A rotary switch R is synchronized with a filter 507 to select the variable resistors VR-C, VR-M, and VR-Y. When the disc T is moved to reach the charger 510*a* below the photosensitive medium 514, as shown in FIG. 5, cam Ca at the end of the disc causes a micro-switch MS to be turned on (NC side), passing a selected one of resistors VR-C, VR-M, and VR-Y, each of which is preset as desired, so that the voltage may be applied to the source HVT. In this manner, a suitable high voltage is applied to the charger for every color process so that the surface potential on the photosensitive plate may be set to such an optimum value that a latent image is formed suitable for each color development.

Figure 7:
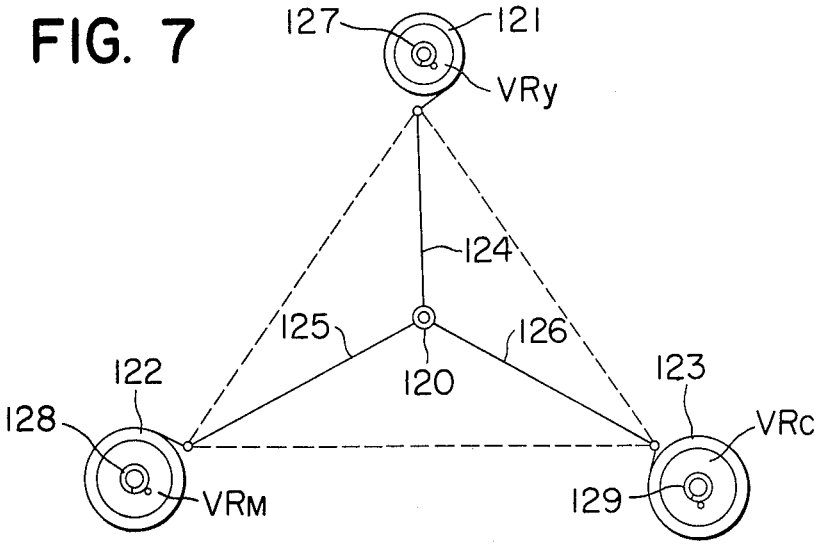
FIG. 7 is a plan view showing a mechanism for relatively controlling a potential of each electrostatic latent image.

FIG. 7 illustrates a color balance controlling mechanism. This is an example of a mechanism capable of performing a mechanical control, in which the values of the variable resistors $VR_Y$, $VR_M$, and $VR_C$ are changed in relation to each other for the purpose of charge setting in the above-mentioned color representing process. The resistors are set at each of the apexes of a triangle as indicated by the dotted lines. These variable resistors have their operating shafts provided with pulleys 121, 122, and 123, respectively, of a predetermined diameter, threads 124, 125, and 126 one end of which is each tied to a control lever 120 have their other ends each wound on each of said pulleys. On each shaft of these variable resistors is disposed coil springs 127, 128, and 129, respectively, which are normally tensioned so as to prevent slackening of the threads.

Figure 8:
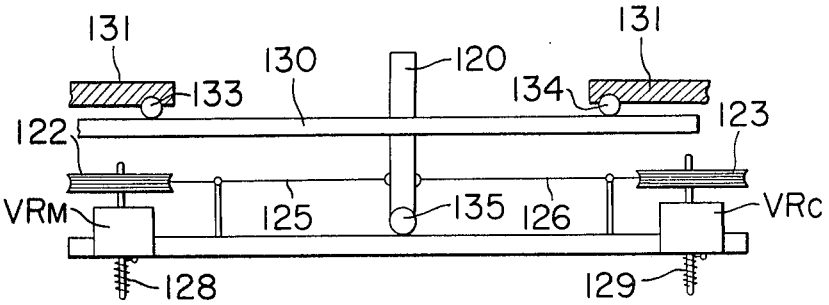
FIG. 8 is a side view of the mechanism of FIG. 7.

As shown in FIG. 8, which is a side view, the control lever 120 is disposed on a flat plate 130, which is movably held between upper plate 131 and lower plate 132 by ball bearings 133, 134, 135 or the like. Accordingly, this operating lever 120 may be set in a suitable position within the triangle as indicated at the dotted lines. Each of the resistor values may be simultaneously controlled in accordance with the distance from each apex of the triangle to the operating lever which changes with the movement of the operating lever 120.

Figure 9:
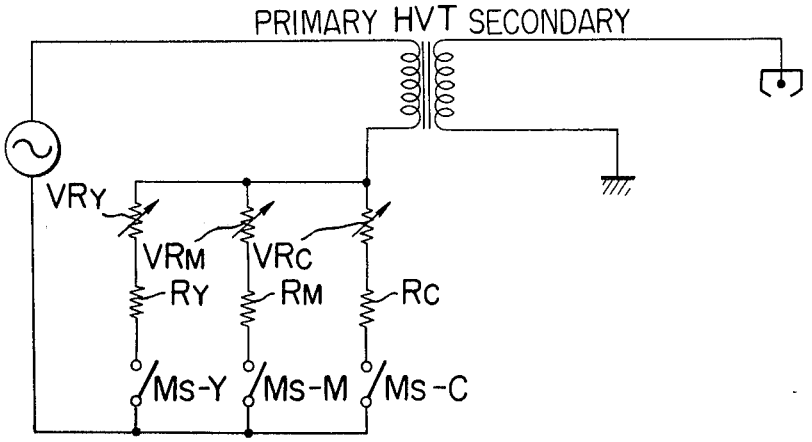
FIGS. 9 and 10 are control circuit diagrams of a preferred embodiment to which the mechanism of FIG. 7 is applied.

FIG. 9 is an example of the charge control circuit. In accordance with the representation image colors such as yellow, magenta, and cyan, micro-switches MS-Y, MS-M, and MS-C are provided in a manner similar to that previously described, and these microswitches are selected and set to control the charge for the desired representation color. Auxiliary controlling resistors are designated as at $R_y$, $R_m$, and $R_c$.

Figure 10:
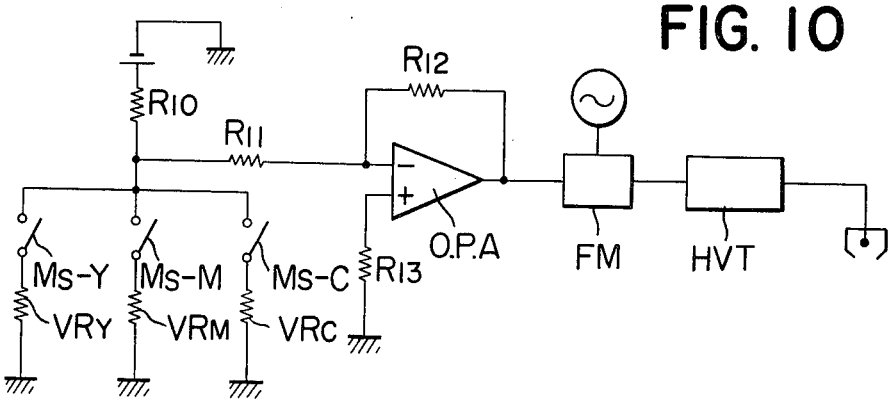

FIG. 10 is a modified high voltage control circuit. The output of an operational amplifier O.P.A. is provided by selecting and changing-over the variable resistors $VR_Y$, $VR_M$, and $VR_C$ associated as described above to control the charge, and the above output is modulated by a ring modulator FM so as to actuate the high voltage source HVT.

Figure 11:
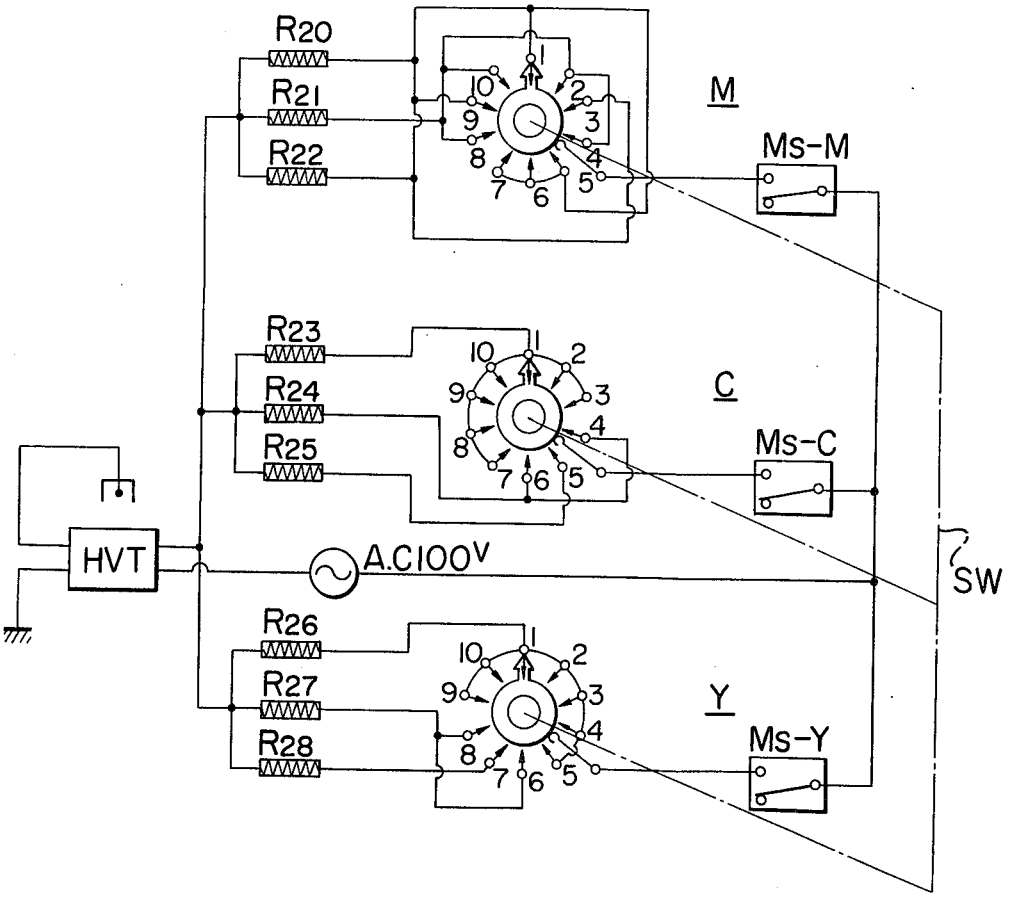
FIG. 11 is a circuit diagram of a control mechanism in a different form.

Referring now to FIG. 11 showing a control circuit, a three-layer rotary switch SW provided with 10 contacts on a single stage is used, and a potential value on the input side of the high voltage source transformer may be set in accordance with selection and change-over of each charging cycle of cyan, magenta, and yellow. Thus setting of the voltage may be accomplished to relatively vary the resistance by color in response to the movement of the dial on the rotary switch thereby controlling the density level of an image in each color to control the color balance.

Figure 12:
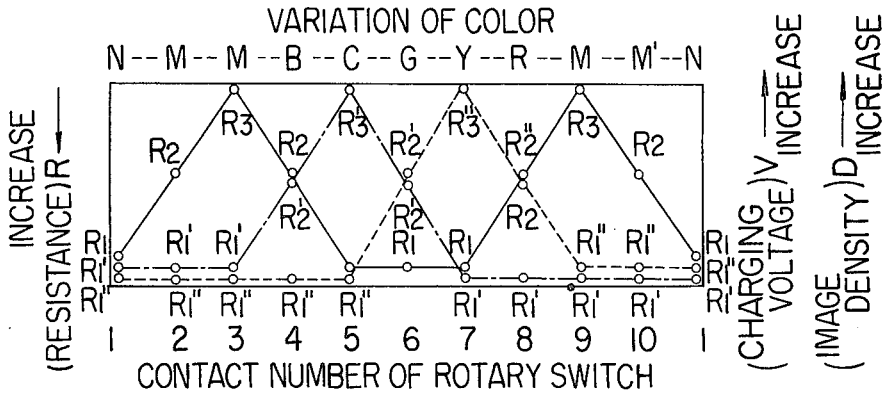
FIG. 12 is a view of assistance in explaining the control operation of the circuit in FIG. 11.

FIG. 12 schematically illustrates the relationship among variation of series-connected resistances to respective contacts of the rotary switch SW, variation of charging voltages and variation of color in copied images, in the preferred embodiment. As for the variation of color, as the rotary switch SW rotates, accentuated colors are varied in an endless fashion in order of normal color balance (normal) No. 1, magenta tones No. 2 and No. 3, blue tone No. 4, cyan tone No. 5, green tone No. 6, yellow tone No. 7, red tone No. 8, magenta tones No. 9, and No. 10, normal color balance (normal).

Figure 13:
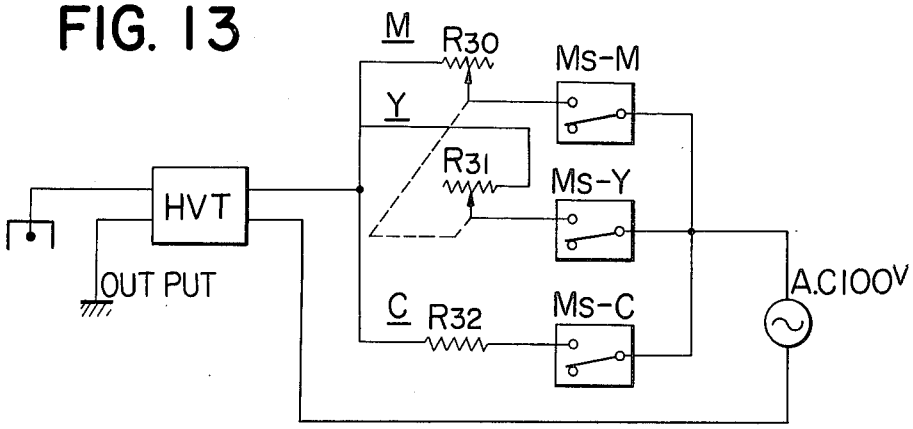
FIG. 13 is a circuit diagram of a control mechanism in a simplified form.

The circuit shown in FIG. 13 is in a simplified form of the circuit as previously mentioned above and yet enables sufficient color balance control. In the illustrated control, one color is used as a reference color (for example, cyan), and the other colors are made to match the reference color to acquire balance. More specifically, a coaxial variable resistor whose resistances may be varied in the opposite direction from one another with respect to the rotational direction is used to vary respective resistances of the input side of the power source of the high voltage source transformer, thereby varying the charging voltage to control the density level of an image in magenta and yellow.

Figure 14:
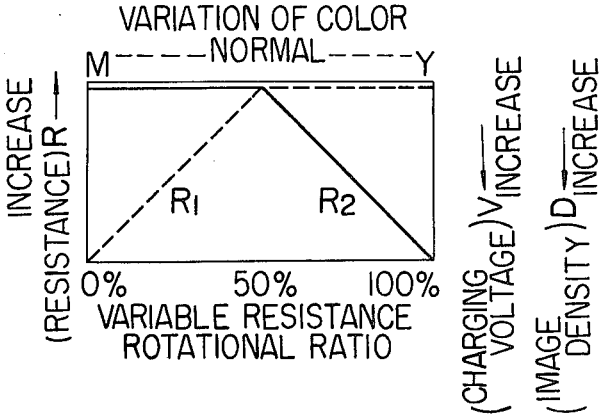
FIG. 14 is a view of assistance in explaining the control operation of the circuit shown in FIG. 13.

FIG. 14 schematically illustrates the relationship among variation of resistances to extent of rotation of the variable resistor according to the preferred embodiment, variation of charging voltages and image density, and variation of color. As for the variation of color, as the variable resistor rotates, accentuated colors are varied in the order of magenta tone, normal color balance (normal), and yellow tone. In the illustrated embodiment, cyan was used as a reference color, but it will be of course apparent that other colors may be used as a reference color, and combinations thereof may also be used as desired.

Figure 15:
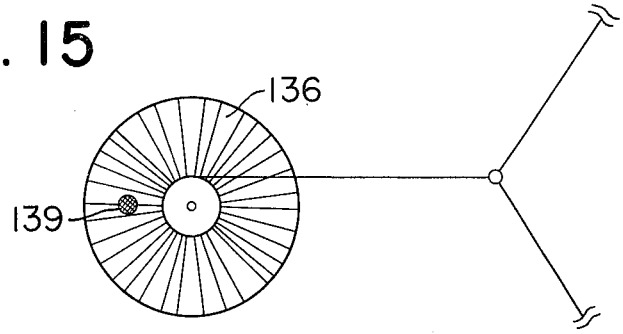
FIG. 15 is an improved view of the FIG. 7 mechanism in an optical detection form.

FIG. 15 is an example wherein the resistance may be optically set. In this embodiment, integral with and rotatably mounted on the pulley 121 is a filter plate 136 adapted to vary the density in the peripheral direction, in place of the variable resistor as shown in FIG. 7, and the light source and light receiving element are provided interposing the filter plate therebetween. With this structure, the filter plate also rotates as the pulley rotates by movement of the operating lever, and the setting condition may be established according to the light transmitted at the light receiving position according to variation of the plate.

Figure 16:
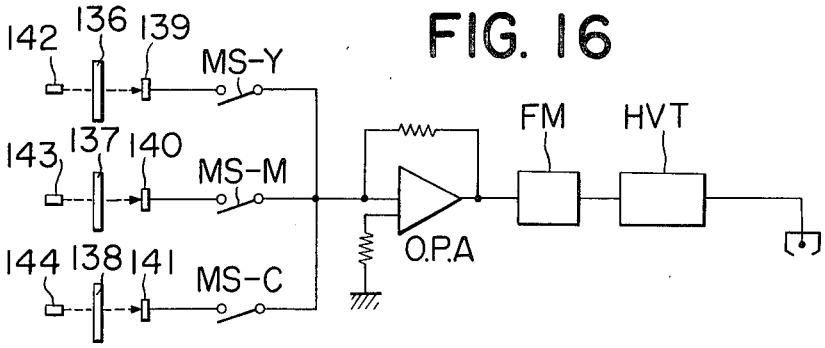
FIG. 16 is a control circuit diagram of a preferred embodiment of the mechanism shown in FIG. 15.

FIG. 16 is a circuit diagram wherein a signal received from the light receiving element is formed into a control signal. The light beams from light sources 142, 143, and 144 are incident upon light receiving elements 139, 140, and 141, respectively, through filters 136, 137, and 138, and input signals resultant from the incidence of the light are taken out as a predetermined signal by selecting the micro-switches MS-Y, MS-M, and MS-C. The operation after completion of changing-over the light receiving elements may be performed in a manner substantially similar to that of the circuit shown in FIG. 10.

Figure 17:
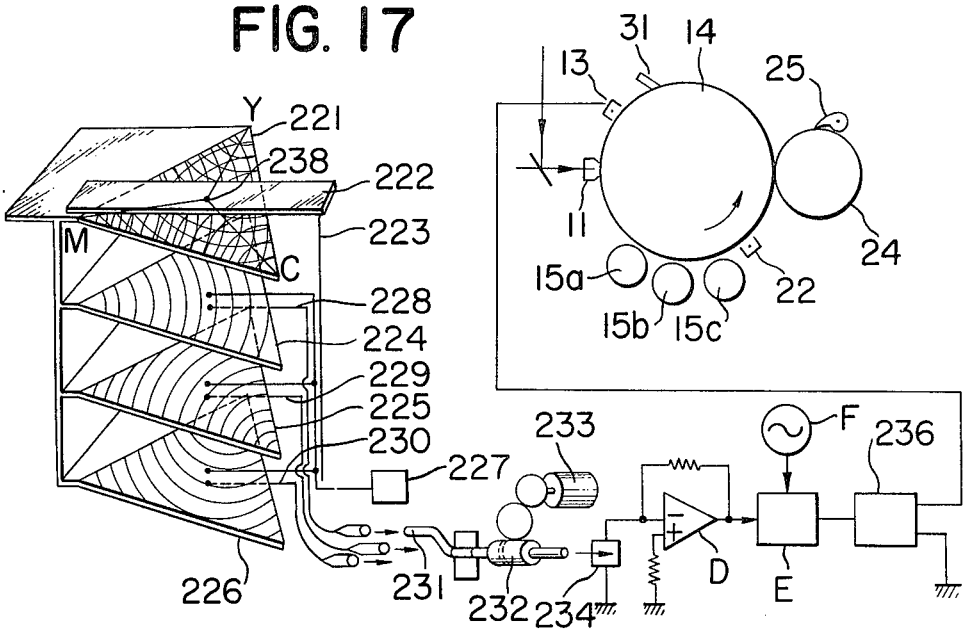
FIG. 17 is a perspective view of a mechanism wherein the potential of an electrostatic latent image is optically set and controlled.
Figure 18:
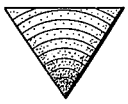
FIG. 18 is a view of assistance in explaining the structure of a filter applicable to the mechanism shown in FIG. 17.

FIG. 17 illustrates a preferred embodiment in a modified form of the optical control, wherein movable parts are decreased in number to insure that the setting may be wholly accurately made. More specifically, in the above-mentioned embodiment, it was necessary to change plane movement into rotational movement while in the embodiment shown in FIG. 17, only the plane movement of elements will suffice. Filter plates 224, 225, and 226, whose density varies in a contour fashion, are provided with respect to the apex of a triangle as shown in FIG. 18, and three colors of an indicating plate 221 with the density indicated in a contour line are arranged so that the direction of variation of density for each of filter plates may be determined. A setting plate 222 disposed movable on the indicating plate may be moved integral with a light source 227 and light receiving elements 228, 229, and 230 disposed on front and back of each filter. In the illustrated embodiment, each filter is provided with an optical fiber at the light receiving position thereof, and each setting may be detected by a light receiving element 234 disposed at the end opposite the optical fiber 231 which rotates and selectively receives a light signal from each of said optical fibers. The signal thus detected is amplified by an amplifier, and the high voltage source may be actuated by said signal at a predetermined voltage. As shown, the signal incident upon the light receiving element 234 is received by a converter D, and the output voltage corresponding to the quantity of light incident upon the light receiving element emerges out of the converter.

This output voltage is subjected to amplitude modulation at a ring modulator E through modulation wave from an oscillator F and is then transmitted into input of a high voltage transformer 236. In this manner, the output voltage of the high voltage source may be set, whereby each charge is set in proportional to the transmitted quantity of light according to the density which varies in a contour fashion and the control of each color may always be relatively held. When a setting reference point 238 provided on the setting plate 222 is set in a central position of the indicating plate 221, the transmitted quantity of light of each filter will be equalized. As for example, if magenta is desired to be darker, it is only necessary to move the setting reference point onto the center of Y-C axis in FIG. 17. The set value according to each color representation may be changed over by driving a drive motor 233 in accordance with the change-over of the filter provided on a projection path of the original image to the surface of the photosensitive medium so as to rotate a rotational mechanism 232 of the light receiving fiber adapted to have a light signal from a predetermined detecting plate incident upon the amplifier. If a plurality of light receiving elements is provided, instead of rotating and changing-over the light receiving fiber as described above, it will be apparent that on-off control of the connection may be effected. Although the above-described density indicating plate and detecting plate have been described in the form of a triangle as shown in FIGS. 17 and 18, it is to be understood that a suitable shape other than those noted above may also be employed. It is also to be understood that the transmission density of the density detecting plate may be determined so that the transmittivity is highest at point M conversely to the case as shown in FIG. 18 and is decreased as it becomes distant toward the periphery, and it is further to be understood that the ratio of the variation in transmittivity in a position as described above may be set as desired.

Figure 19:
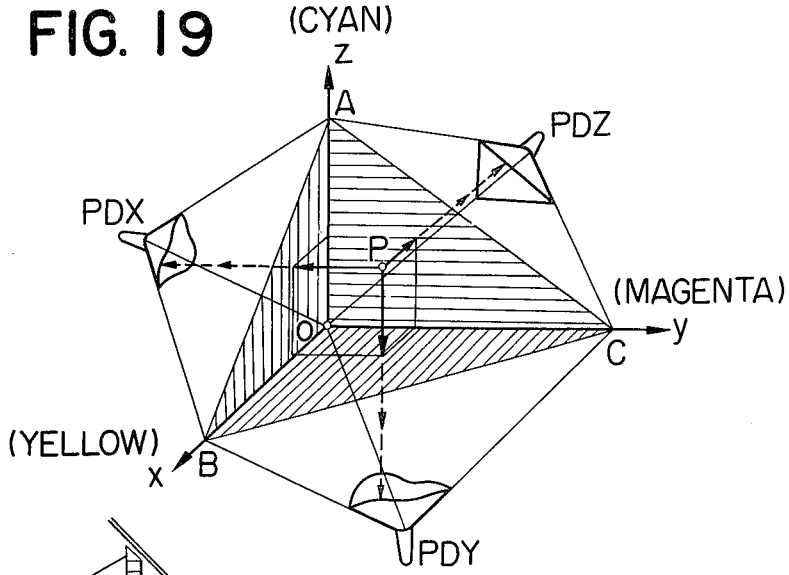
FIG. 19 is a view showing a mechanism in a modified form of a preferred embodiment wherein optical detection is effected.

FIG. 19 shows a further modified embodiment. In this figure, the point P designates a setting point of color balance, which point is movable within a plane including equi-distant points A, B, and C on axes *x*, *y*, and *z*, respectively. There is provided a lamp house which illuminates light perpendicularly to the plane formed by *xy*, *zy*, and *zx* from the point P, and light beams are transmitted through a filter having a continuous or stepwise density as in FIG. 18 and mounted on the plane *xy*, *yz*, and *zx*, the light beam having a brightness corresponding to the coordinate of the point P being entered photodetectors PDX, PDY, and PDZ.

Figure 20:
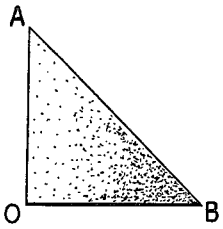
FIG. 20 is a view of assistance in explaining the structure of a filter used in the mechanism of FIG. 19.

FIG. 20 shows a filter having plane ABO. This filter is designed so that in the plane AOC, the best transmittivity is obtained on the line OC and worsens as it directs toward the point A. The coordinate position of the point P may be subjected to photoelectric conversion by these three filters ABO, BCO, and CAO so as to find the position thereof by a voltage signal.

Figure 21:
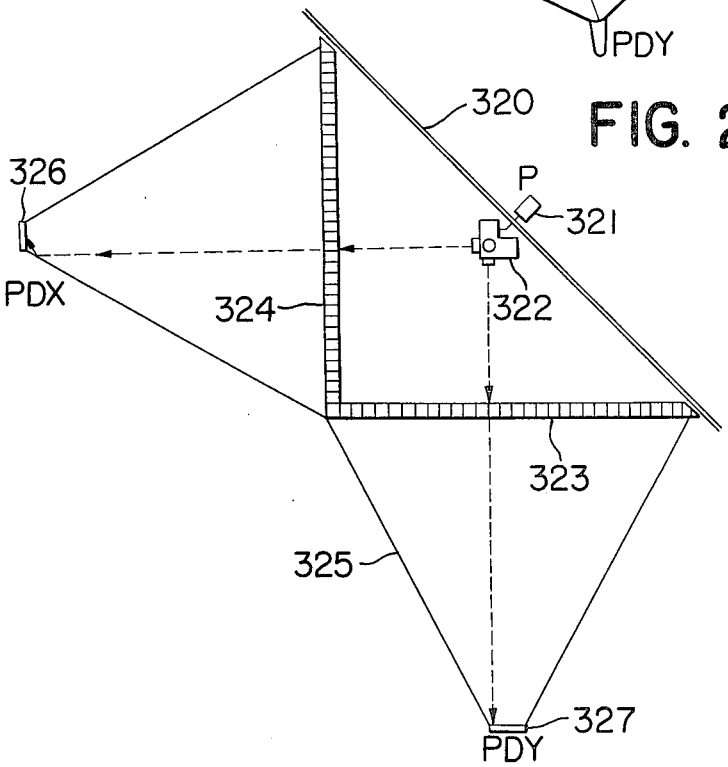
FIG. 21 is a side view of the mechanism shown in FIG. 19.

FIG. 21 is a sectional view as viewed from axis *x*. The arrangement comprises a lamp house 322, a setting plate 320 on which the lamp house 322 is mounted, a setting knob 321, a *y*-component detecting filter 324, a guide wall 325 for introducing the light beams received into a photodetector, a light receiving element 326 for reading an *x*-component, and a light receiving element 327 for reading a *y*-component.

Figure 22:
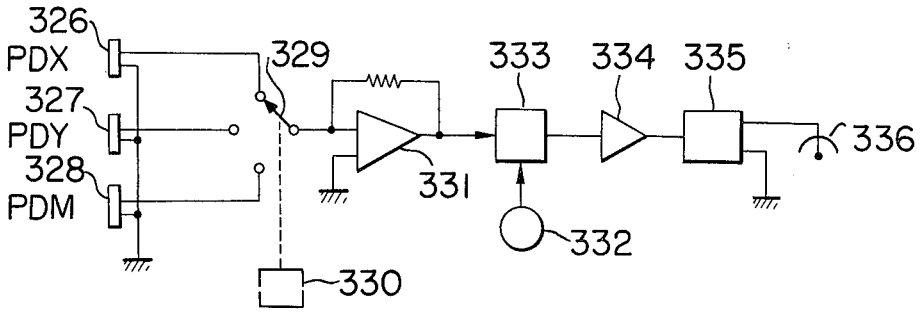
FIG. 22 is a control circuit diagram of a preferred embodiment of the mechanism shown in FIG. 19.

FIG. 22 is an electric system diagram of the device as described above. That is, photodetector 326 (PDX) serves to determine the yellow component, photodetector 327 (PDY) serves to determine the magenta component, and photodetector 328 (PDZ) serves to determine the cyan component. Here, PDX + PDY + PDZ = constant. The system comprises a rotary switch 329 to be switched according to processes of yellow, magenta, and cyan, a rotary switch driving means 330, a circuit 331 for converting an output of the light receiving element into a voltage signal, an oscillator 332, a ring modulator 333, an amplifier 334, a high voltage transformer 335, and a charger 336. When a setter P is set to a suitable position, the components of axes *x*, *y*, and *z* at the point P may be read at the light receiving elements by the light beams from the lamp house to be illuminated perpendicularly to three planes at right angles, and in the case of the yellow process, the signal of the light receiving element PDX enters convertor 331 through the rotary switch 329 for modulation and amplification and then into the high voltage transformer 335 thereby imparting a predetermined primary charge to the photosensitive drum. In the next magenta process, the switch 329 is switched by the drive circuit 330 to introduce the signal of the light receiving element PDY, i.e., the setting of magenta into the high voltage transformer through the switch 329 thereby imparting the primary charge required for magenta to the photosensitive drum. The same procedure is true for cyan.

From the above, it will be noted that the provision of a color balance control mechanism enables one to properly set the charging conditions of the color representation processes, or independently the exposure of the original image onto the surface of the photosensitive medium may be effectively controlled according to each resolving color.

Figure 23:
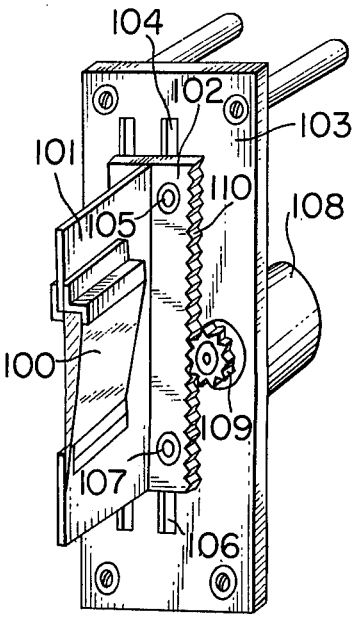
FIG. 23 is a partially sectional perspective view of an exposure control mechanism in a modified form according to the present invention.
Figure 24:
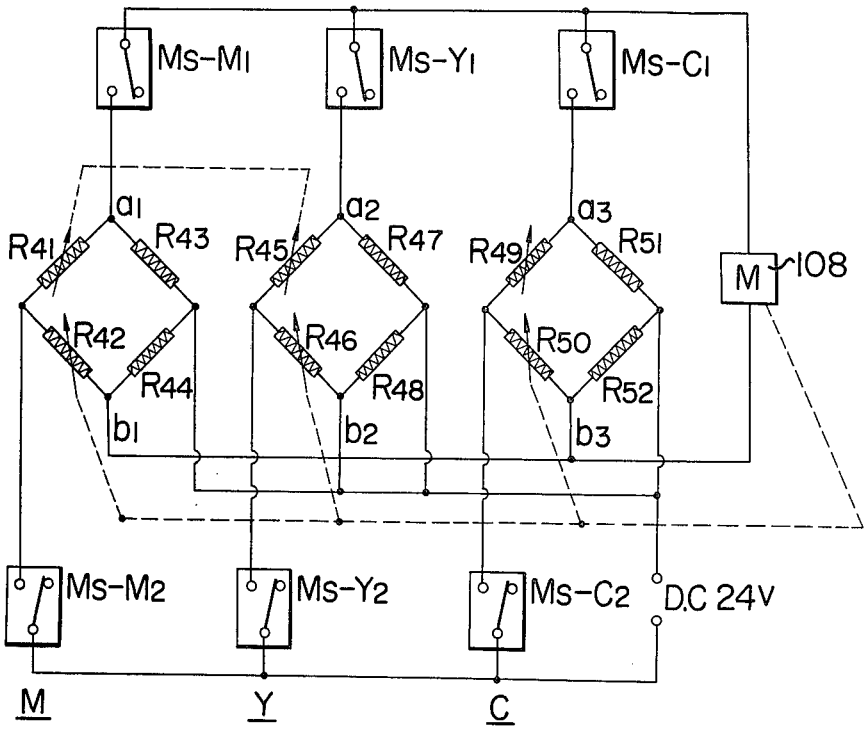
FIG. 24 is a circuit diagram of a preferred embodiment of the mechanism shown in FIG. 23.

FIG. 23 shows a preferred embodiment of an exposure control mechanism, wherein a ND filter which continuously varies density is moved substantially vertically on a light path. FIG. 23 is a fragmentary perspective view showing the half of the mechanism, in which a wedge type uniform density filter 100 is used to control the quantity of transmitted light. The filter 100 is disposed on a window portion of a movable base plate 101, whereas the plate 101 is received and guided along guide slots 104 and 106 formed in a base plate 103 mounted on the body of the apparatus through guide pins 105 and 107 disposed on a support plate 102 at right angles to the movable base plate 101 so that the plate 101 may be vertically moved. The base plate 103 has a servo-motor 108 mounted thereon, and a servo-motor driving gear 109 is meshed with a rack gear 110 mounted on the side end of the support plate 102 to control movement of the filter 100. The servo-motor adapted to move the filter may be controlled by a circuit shown in FIG. 24. In FIG. 24, resistors $R_{41}$–$R_{44}$, $R_{45}$–$R_{48}$, and $R_{49}$–$R_{52}$ constitute Wheatstone bridges for control circuits of magenta, yellow, and cyan, respectively. Resistors $R_{41}$, $R_{45}$, $R_{49}$ and $R_{42}$, $R_{46}$, $R_{50}$ are variable resistors, all of or a set of resistors $R_{41}$, $R_{45}$, and $R_{49}$ are operated in cooperation with each other, while resistors $R_{42}$, $R_{46}$, and $R_{50}$ are formed to be variable with a servo-motor (M) 108. Prior to the exposure operation, a micro-switch for a predetermined color is turned on according to a color image to be represented, and for example, in the case of the cyan representation, the servo-motor (M) 108 is rotated during the presence of a potential difference between points $a_3$ and $b_3$ in the bridge. With rotation of the servo-motor, the variable resistor 50 is varied, and when the potential becomes "O", the servo-motor (M) 108 is turned off to set a slit in its optimum position. This operation is accomplished in order for each color according to the change-over of the microswitch. In the illustrated embodiment, variable resistors $R_{41}$ and $R_{45}$ in the control circuits for magenta and yellow, respectively, are rotated in a cooperating relationship, and values of resistors are to be varied in opposite directions. The resistor $R_{49}$ is a trimming or variable resistor.

Figure 25:
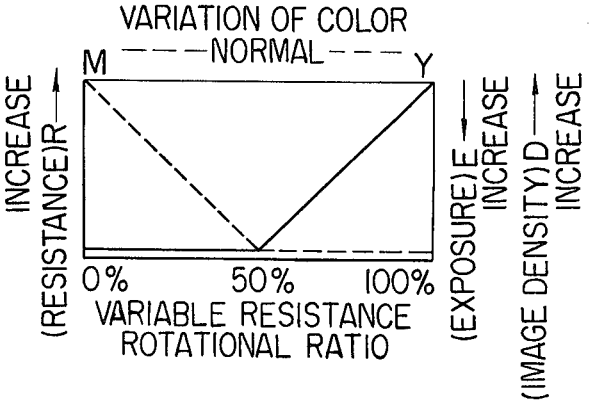
FIG. 25 is a view of assistance in explaining the control operation of the circuit shown in FIG. 24.

FIG. 25 schematically illustrates the mutual relationship among the value characteristics of resistors $R_{41}$ and $R_{45}$, variation of exposures, and imagedensity.

As previously described, it is noted that resistors $R_{41}$, $R_{45}$, and $R_{46}$ may be operated in cooperation with each other to control all the colors.

For a better understanding, the present invention will be described with reference to a further preferred embodiment.

EXAMPLE 1

A layer of image quality control material is placed on a transparent conductive polyester film Hi-BEAM T (Trade Mark, TOYO REIYON Co. Ltd.), on which is coated a photosensitive layer principally comprised of a polyvinylcarbazole and is then dried to form a photosensitive plate. This photosensitive plate was subjected to three repetitions of each process of charging, rear exposing, developing, and drying with use of a copying machine shown in FIG. 5.

During the process as above described, exposing filters as listed in Table 1 below were used.

Table 1

| | | |
|---|---|---|
| Cyan development: | (Kodak Wratten Filter) | No. 25 |
| Magenta development: | (Kodak Wratten Filter) | No. 58 |
| Yellow development: | (Kodak Wratten Filter) | No. 47 |

Figure 26:
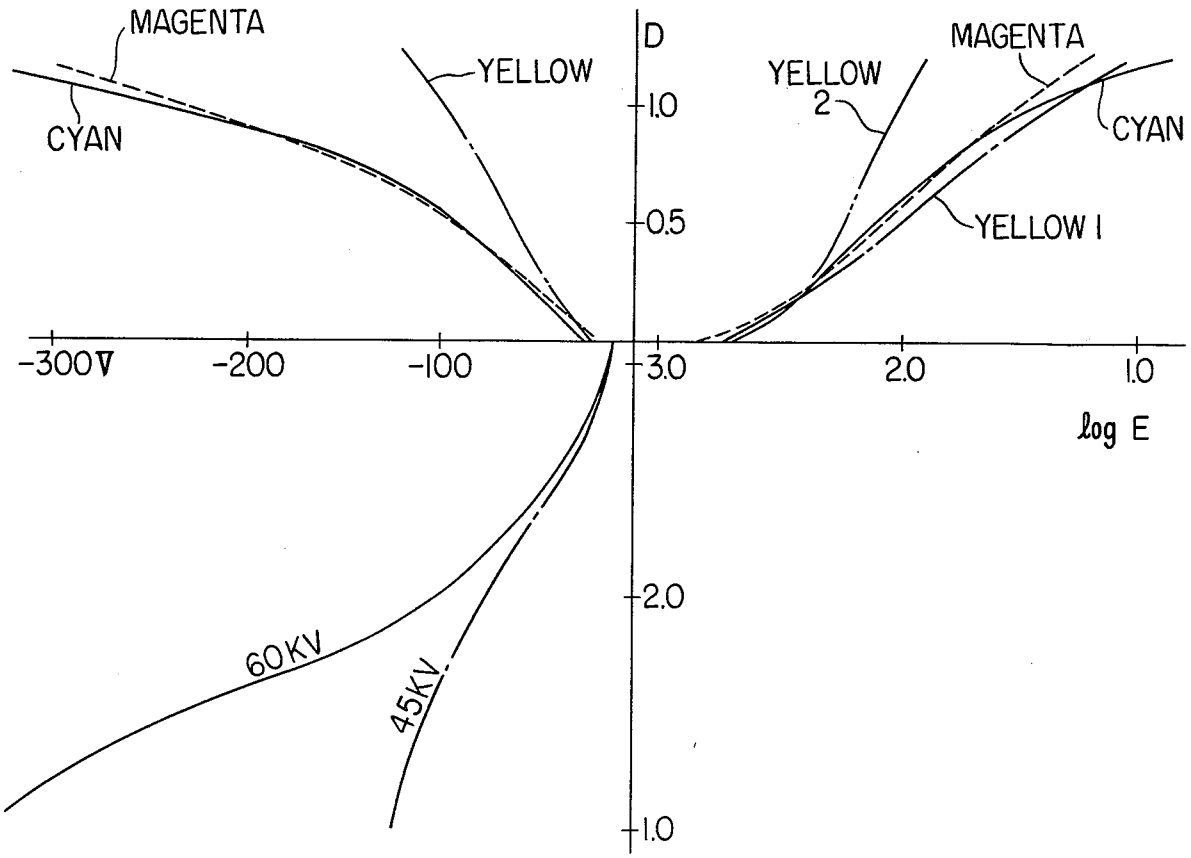
FIG. 26 is a characteristic curve of charged development in Embodiment 1.

The V-D characteristic curve of toner used in the embodiment is shown in the third quadrant of FIG. 26.

As shown in the curves, the V-D characteristic curves for magenta and cyan are almost registerd, but the V-D characteristic for yellow is different from those just mentioned above.

Copies are produced under the same charging condition with use of these three toners, and the resultant image has only yellow appearing to be a rather hard tone as shown at cyan, magenta, and yellow 2 in the first quadrant of FIG. 26, thus being unable to obtain a better color balance. On the other hand, an attempt has been made to form an image with a corona voltage of 4.5 KV only during the representation of the yellow resolved image separation step, and as a result, the image having the characteristic as shown as yellow 1 was obtained, and the color representation image combined with other magenta and cyan showed an excellent color balance among all colors.

EXAMPLE 2

An aluminum foil was coated thereon with a coating material with cadmium sulfide dispersed into resins and was dried to form a photosensitive layer of 40 μ. On this layer is pasted a polyester film of 25 μ to form a three-layer photosensitive plate.

Prior to copying, the photosensitive plate thus obtained is attached to the photosensitive drum 14 of the copying machine shown in FIG. 3. The E-V characteristics of red, green, blue, and ND filters resulted from the exposure of step wedges with the voltage applied to a primary charger 13 (6.2 KV) and an AC discharger 11 (6.0 KV) kept constant by use of the copying machine are shown by curves R, G, and B in FIG. 27.

Figure 27:
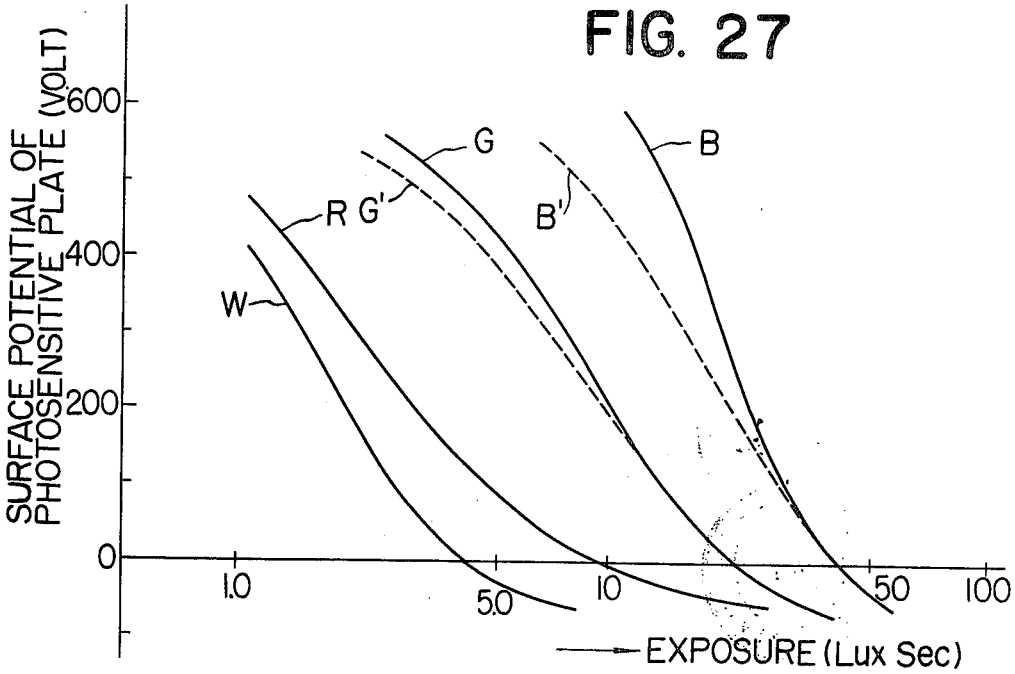
FIG. 27 is a characteristic curve of the exposure and charge in Embodiment 2.

In FIG. 27, the curves show greater inclination in order of R, G, and B because of the difference produced due to the fact that the light beams of short wave length are absorbed in the vicinity of surface of the photosensitive plate while the light beams of long wave length penetrate further into the photosensitive layer. These electrostatic latent images were developed with use of cyan, magenta, and yellow toners having a substantially similar V-D characteristic, but a better color balance was not obtained.

The charging condition controlling mechanism shown in FIG. 4 was controlled, and NVT-1 (primary charging positive high voltage source) and HVT-2 (AC discharging AC high voltage source) were set as listed in Table 2 below.

Table 2

| | Primary | AC |
|---|---|---|
| Charging condition for green filter | +6.0 KV | 6.0 KV |
| Charging condition for blue filter | +5.8 KV | 5.7 KV |

The electrostatic latent images obtained under the above conditions are indicated as at G′ and B′ in FIG. 27, and the images having a better color balance were obtained with R under the same condition as the initial condition and the exposure.

From the detailed description of the preferred embodiments as discussed above, it will be apparent in the present invention that the process condition may be well controlled according to each process of color representation so that the color representation faithful to the original may be readily attained.

The present invention provides the arrangement wherein the charging condition is well controlled according to each process of each color representation to thereby readily acquire a better control balance of density of each color representation.

The present invention further provides a control for keeping the color balance constant of each representation color.

We claim:

1. A color electrophotographic apparatus wherein color resolved light images of an original are exposed onto a photosensitive medium to form a series of separate color resolved electrostatic latent images, comprising:

a movable photosensitive medium;

voltage charge applying means for applying a voltage charge to said photosensitive medium, and means for exposing the photosensitive medium with color resolved light images of an original to form successive color resolves latent images thereon; a plurality of adjustable voltage control means for varying the voltage of the charge applying means according to each color resolved light image;

means for simultaneously adjusting said plurality of voltage control means relative to each other for varying the relationship between the voltage charges applied to the photosensitive medium; and programming means for selectively coupling individual ones of said voltage control means to said charge applying means during the formation of said successive color resolved latent images.

2. A color electrophotographic apparatus as set forth in claim 1, in which said voltage control means and said adjusting means cooperate to control said charge applying means wherein the sum of the voltages for series of images is constant irrespective of adjustments of said voltages.

3. A color electrophotographic apparatus as set forth in claim 1, wherein said adjustable voltage control means includes a filter having a color density gradient with respect to light passing therethrough, and including a light emitting element at one side thereof and a light receiving element at the other side thereof, means for providing selective relative movement between said light emitting and receiving elements and said filter, and means coupled to said light receiving element for varying the voltage of said charge applying means prior to the formation of one of said color resolved latent images.

4. A color electrophotographic apparatus as set forth in claim 1, wherein each of said plurality of adjustable voltage control means includes a plurality of resistor elements, and a selector switch for selectively connecting one of said resistors together with said charge applying means and a voltage source, and wherein said programming means includes a second switch for selectively completing a series circuit between the power source the charge applying means, and one of said adjustable voltage control means.

5. A color electrophotographic apparatus wherein color resolved light images of an original are exposed onto a photosensitive medium to form separate color resolved electrostatic latent images in sequence comprising:

a movable photosensitive medium;

variable voltage charge applying means for applying a voltage charge to said photosensitive medium, and means for exposing the photosensitive medium with color resolved light images of an original to form successive color resolved latent images thereon;

a plurality of adjustable voltage control means, corresponding in number to the respective separate colors, for setting the voltage of the charge applying means according to each color resolved light image;

means for simultaneously adjusting said plurality of voltage control means relative to each other for varying the relationship between the voltage charges applied to the photosensitive medium;

a plurality of different color developer means for developing corresponding said separate color resolved electrostatic latent images; and programming means for selectively coupling individual ones of said voltage control to said charge applying means during the formation of said successive color resolved latent images.

6. A color electrophotographic apparatus as set forth in claim 5, wherein each of said plurality of adjustable voltage control means includes a variable resistor.

7. A color electrophotographic apparatus as set forth in claim 5, wherein each of said plurality of adjustable voltage control means includes a filter, and a light source and a photosensitive element disposed on opposite sides of the filter, wherein the filter has a color concentration gradient, means for providing selective relative movement between said light emitting and receiving elements and said filter, and means coupled to said light receiving element for varying the voltage of said charge applying means prior to the formation of one of said color resolved latent images.

8. A color electrophotographic apparatus as set forth in claim 5, further comprisng means for transferring the developed images onto a recording medium.

9. A color electrophotographic apparatus wherein color resolved light images of an original are exposed onto a photosensitive medium to form separate color resolved electrostatic latent images in sequence comprising:

a movable photosensitive medium having an insulative surface for bearing latent images;

a variable voltage primary charge applying means for applying a primary voltage charge of predetermined polarity to said photosensitive medium, means for exposing the photosensitive medium with color resolved light images of an original, and means for applying a secondary charge to said photosensitive medium simultaneously with said color resolved light image exposures, wherein said secondary charge is applied by an AC discharger, or a DC charger operated at a polarity opposite to said predetermined polarity, to form successive color resolved latent images on said insulative surface;

a plurality of voltage control means, corresponding in number to the respective separate colors, for setting the voltage of the prim-ry charge applying means according to each color resolved light image;

means for simultaneously adjusting said plurality of voltage control means relative to each other; and programming means for selectively coupling individual ones of said voltage control means to said primary charge applying means during the formation of said successive color resolved latent images.

10. A color electrophotographic apparatus according to claim 9, further comprising a plurality of second voltage control means for setting the voltage of the secondary charge applying means according to each color resolved light image, wherein said programming means further includes means for selectively coupling individual ones of said secondary voltage control means to said secondary charge applying means during the formation of said successive color resolved latent images.

11. A color electrophotographic apparatus according to claim 10, further comprising means for simultaneously adjusting said plurality of secondary voltage control means relative to each other, for varying the relationship between the secondary voltage charges applied to the photosensitive medium.

12. A color electrophotographic apparatus according to claim 11, wherein each of said plurality of adjustable voltage control means includes a filter, and a light source and photosensitive element disposed on opposite sides of the filter, wherein the filter has a color concentration gradient, means for providing selective relative movement between said light emitting and receiving elements and said filter, and means coupled to said light receiving element for varying the voltage of said charge applying means prior to the formation of one of said color resolved latent images.

13. A color electrophotographic apparatus according to claim 9, wherein each of said plurality of adjustable voltage control means includes a filter and a light source and a photosensitive element disposed on opposite sides of the filter, wherein the filter has a color concentration gradient, means for providing selective relative movement between said light emitting and receiving elements and said filter, and means coupled to said light receiving element for varying the voltage of said charge applying means prior to the formation of one of said color resolved latent images.

14. A color electrophotographic apparatus wherein color resolved light images of an original are exposed onto a photosensitive medium to form separate color resolved electrostatic latent images comprising:

a movable photosensitive medium having an insulative surface for bearing latent images;

a variable voltage primary charge applying means for applying a primary voltage charge of predetermined polarity to said photosensitive medium, means for exposing the photosensitive medium with color resolved light images of an original, means for applying a secondary charge to said photosensitive medium simultaneously with said color resolved light image exposures, wherein said secondary charge is applied by an AC discharger, or a DC charger operated at a polarity opposite to said predetermined polarity, and means for subsequently providing an overall light exposure to the image area of the insulative surface, to form successive color resolved latent images on said insulative surface;

a plurality of voltage control means corresponding to respective separate colors for setting the voltage of the primary charge applying means according to each color resolved light image;

a plurality of different color developer means for developing corresponding ones of said separate color resolved electrostatic latent images;

means for simultaneously adjusting said plurality of voltage control means relative to each other for varying the relationship between the primary voltage charges; and programming means for selectively coupling individual ones of said voltage control means to said primary charge applying means during the formation of said successive color resolved latent images, and for selectively actuating said plurality of developer means to develop said successive latent images.

15. A color electrophotographic apparatus according to claim 14, further comprising a plurality of secondary voltage control means for setting the voltage of the secondary charge applying means according to each color resolved light image, wherein said programming means further includes means for selectively coupling individual ones of said secondary voltage control means to said secondary charge applying means during the formation of said successive color resolved latent images.

16. A color electrophotographic apparatus according to claim 15, further comprising means for simultaneously adjusting said plurality of secondary voltage control means relative to each other, for varying the relationship between the primary voltage charges and the relationship between the secondary voltage charges applied to the photosensitive medium.

17. A color electrophotographic apparatus according to claim 16, wherein each of said plurality of adjustable voltage control means includes a filter, and a light source and a photosensitive element disposed on opposite sides of the filter, wherein the filter has a color concentration gradient, means for providing selective relative movement between said light emitting and receiving elements and said filter, and means coupled to said light receiving element for varying the voltage of said charge applying means prior to the formation of one of said color resolved latent images.

18. A color electrophotographic apparatus wherein color resolved light images of an original are exposed onto a photosensitive medium to form separate color resolved electrostatic latent images comprising:

a movable photosensitive medium having an insulative surface for bearing latent imates;

a variable voltage primary charge applying means for applying a primary voltage charge of predetermined polarity to said photosensitive medium, means for exposing the photosensitive medium with color resolved light images of an original, means for applying a secondary charge to said photosensitive medium simultaneously with said color resolved light image exposures, wherein said secondary charge is applied by an AC discharger, or a DC charger operated at a polarity opposite to said predetermined polarity, and means for subsequently providing an overall light exposure to the image area of the insulative surface, to form successive color resolved latent images on said insulative surface;

a plurality of voltage control means corresponding to respective separate colors for setting the voltage of the primary charge applying means according to each color resolved light image;

means for simultaneously adjusting said plurality of voltage control means relative to each other for varying the relationship between the primary voltage charges;

a plurality of different color developer means for developing corresponding said separate color resolved electrostatic latent images;

means for transferring the developed images onto a recording medium; and programming means for selectively coupling individual ones of said voltage control means to said primary charge applying means during the formation of said successive color resolved latent images, and for selectively actuating said plurality of developer means to develop said successive latent images.

19. A color electrophotographic apparatus according to claim 18, further comprising a plurality of second voltage control means for setting the voltage of the secondary charge applying means according to each color resolved light image, wherein said programming means further includes means for selectively coupling individual ones of said secondary voltage control means to said secondary charge applying means during the formation of said successive color resolved latent images.

20. A color electrophotographic method of reproducing a color original comprising the steps of:

applying a selected charging voltage to a photosensitive medium so that the medium is uniformly charged;

exposing the charged photosensitive medium to a color resolved image obtained from the original;

developing the image so produced on said photosensitive medium with a developer selected to reproduce the color associated with the image; and transferring the developed image onto a recording medium, said steps being repeated with respect to each of a number of different color resolved images to obtain superimposed reproduced color images on said recording medium, each of the selected charging voltages being selected with respect to corresponding ones of the color resolved images in a first predetermined relationship so that the intensities of each of the reproduced color images are in a second predetermined relationship with respect to one another.

21. A color electrophotographic method of reproducing a color original comprising the steps of:

applying a first selected charging voltage to a photosensitive medium having an insulative layer on its surface so that the medium is uniformly charged in one polarity;

exposing the charged photosensitive medium to a color resolved image obtained from the original;

applying a second selected voltage to the photosensitive medium either to charge the medium in a polarity opposite to said one polarity or to discharge the medium, concurrently with said exposing step;

uniformly exposing the whole surface of the medium to light after said second voltage application step;

developing the image so produced on said photosensitive medium with a color developer selected to reproduce the color associated with the image; and transferring the developed image onto a recording medium, said steps being repeated with respect to each of a number of different color resolved images to obtain superimposed reproduced color images on said recording medium, each of the selected first voltages being selected with respect to corresponding ones of the color resolved images in a first predetermined relationship so that the intensities of each of the reproduced color images are in a second predetermined relationship with respect to one another.

22. A color electrophotographic method in accordance with claim 21, wherein each of the second voltages are selected according to a third predetermined relationship with respect to corresponding ones of the first charging voltages.

23. A color electrophotographic method in accordance with claim 20, wherein each of the charging voltages is selected in accordance with the voltage-density characteristics of the respective color developer which is applied to the charged photosensitive medium.

24. A color electrophotographic method in accordance with claim 20, wherein each of the charging voltages is selected so that the numerical total of all the charging voltages corresponds to the total of the charging voltages at which the densities of each of the color resolved images produced on said photosensitive medium are substantially equal to one another.

* * * * *

UNITED STATES PATENT OFFICE

CERTIFICATE OF CORRECTION

Patent No. 4,106,870 Dated August 15, 1978

Inventor(s) EIICHI KONDO, ET AL

It is certified that error appears in the above-identified patent and that said Letters Patent are hereby corrected as shown below:

Column 6, line 58, change "Thus" to --This--.

Column 10, line 56, change "registerd" to --registered--;

line 68, after "as shown" delete "as" and insert --at--.

Column 11, line 29, change "NVT-1" to --HVT-1--.

Column 12, line 68, after "voltage control" insert --means--.

Column 13, line 42, change "prim-ry" to --primary--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*